US008382583B2

(12) United States Patent
Zinder et al.

(10) Patent No.: US 8,382,583 B2
(45) Date of Patent: Feb. 26, 2013

(54) TOKEN MANAGEMENT SYSTEM AND METHOD OF OPERATION THEREOF

(75) Inventors: Mattiatyh Zinder, Misgav (IL); Avraham Aharonovich, Misgav (IL)

(73) Assignee: Cork Group Trading Ltd., Road Town, Tortola (VG)

( * ) Notice: Subject to any disclaimer, the term of this patent is extended or adjusted under 35 U.S.C. 154(b) by 890 days.

(21) Appl. No.: 12/136,145

(22) Filed: Jun. 10, 2008

(65) Prior Publication Data

US 2008/0318670 A1 Dec. 25, 2008

Related U.S. Application Data

(60) Provisional application No. 60/945,303, filed on Jun. 20, 2007.

(51) Int. Cl.
*A63F 9/24* (2006.01)

(52) U.S. Cl. ..... 463/25; 463/42

(58) Field of Classification Search ..... 463/25, 463/42; 705/64, 66
See application file for complete search history.

(56) References Cited

U.S. PATENT DOCUMENTS

| | | | | |
|---|---|---|---|---|
| 4,882,473 | A | 11/1989 | Bergeron et al. | |
| 5,179,517 | A * | 1/1993 | Sarbin et al. | 463/25 |
| 6,045,447 | A | 4/2000 | Yoshizawa et al. | |
| 6,321,980 | B1 * | 11/2001 | Yazumi et al. | 235/379 |
| 6,554,705 | B1 | 4/2003 | Cumbers | |
| 6,980,962 | B1 * | 12/2005 | Arganbright et al. | 705/14.31 |
| 2002/0077178 | A1 * | 6/2002 | Oberberger et al. | 463/42 |
| 2003/0162591 | A1 * | 8/2003 | Nguyen et al. | 463/29 |
| 2004/0082379 | A1 * | 4/2004 | Yamagishi | 463/25 |
| 2004/0242319 | A1 * | 12/2004 | Walker et al. | 463/25 |
| 2005/0209001 | A1 * | 9/2005 | Moshal | 463/42 |
| 2006/0020556 | A1 * | 1/2006 | Hamnen | 705/59 |
| 2006/0063593 | A2 | 3/2006 | Moshal | |
| 2007/0015570 | A1 * | 1/2007 | Pryzby | 463/25 |
| 2007/0060314 | A1 * | 3/2007 | Baerlocher et al. | 463/25 |
| 2008/0162323 | A1 * | 7/2008 | Menear et al. | 705/35 |

FOREIGN PATENT DOCUMENTS

| | | | |
|---|---|---|---|
| EP | 0 360 613 | A2 | 3/1990 |
| FR | 2872324 | A | 12/2005 |
| WO | WO 99/46741 | A | 9/1999 |
| WO | WO 03/093921 | A | 11/2003 |

OTHER PUBLICATIONS

Kandel, Eugene. The Right to Return. Journal of Law and Economics, vol. XXXIX. Apr. 1996. pp. 329-356.*

(Continued)

*Primary Examiner* — Dmitry Suhol
*Assistant Examiner* — Carl V Larsen
(74) *Attorney, Agent, or Firm* — McDonnell Boehnen Hulbert & Berghoff LLP

(57) ABSTRACT

A method and system for managing tokens in an electronic gaming environment includes managing computer-readable tokens that may be issued by an issuer and transferred to an original recipient of the issued tokens, and thereafter, to one or more players of electronic casino games and/or to electronic gaming devices at which the players intend to play the casino games. The issued tokens may not be redeemable by the issuer, but may be redeemable by the original recipient of the issued tokens or an intermediary device of a hierarchy of devices including the original recipient and the electronic gaming devices. The players may play single-player and/or multi-player games. Tokens wagered during a single-player game may be cancelled if the wager is lost. Tokens wagered during a multi-player game may not be cancelled, but instead transferred to the winner of the multi-player game.

29 Claims, 4 Drawing Sheets

OTHER PUBLICATIONS

Business Wire; MobileGamingNow, Inc. Announces the Launch of the First Ever Mobile Phone Interactive, Multi-Player Gaming System for Poker; 2 pages, Apr. 4, 2005. cited by other.*

Extended European Search Report and European Search Opinion for European Patent Application EP 08252107, European Patent Office, Oct. 13, 2009.

Australian Governtment, IP Australia, Examiner's first report on patentability on patent application No. 2008202671, Feb. 25, 2010.

Canadian Intellectual Property Office, Office action for Canadian Patent Application No. 2,634,892, mailed Jul. 16, 2010.

* cited by examiner

TOKEN MANAGEMENT SYSTEM AND METHOD OF OPERATION THEREOF

RELATED APPLICATION

This application claims the benefit of U.S. Provisional Application No. 60/945,303, filed Jun. 20, 2007. This application incorporates by reference U.S. Provisional Application No. 60/945,303 in its entirety.

BACKGROUND

In traditional online casinos, poker rooms and sportsbooks, a player is first required to register and to create an account on a gaming server of the casino, poker room or sportsbook. The player is then required to pre-fund the account by purchasing credit that can be consumed by the player in wagering and game play activities. The gaming server stores, at all times, a credit balance corresponding to the player's account, which decreases in accordance with wagers made by the player and increases in accordance with any winnings paid out to the player. Such pre-funding is usually made by means of a credit card, debit card, e-wallet, check or wire transfer.

When playing a game at the online casino, or participating in a multi-player poker game at the online poker room, the player may make any wager that is permitted for the particular game being played. The player's wagers are usually denominated in integral units of credit and there must be sufficient credit in the player's account to cover any wager that is made by the player.

The gaming server stores data relating to the type and size of each player's wager in a database on an associated storage device, such as a magnetic or optical disk.

In an online multiplayer poker room, the operator of the poker room levies a commission (or "rake") on the cumulative amount of all player wagers in a multi-player poker game in order to derive revenue. The risk associated with game play is carried by the participating players who risk losing any wagers. It will be appreciated that the operator's rake can only be determined in arrears, once all of the players in the multi-player poker game have finished wagering.

The operator of an online casino, on the other hand, carries the risk associated with game play and is required to pay out all player wins. Traditionally, the revenue of an online casino is a function of a "gross win" derived by the casino over a particular period, which is the sum of all wagers made by players during the period less the sum of all winnings achieved by the players during the same period. As is the case in a multi-player poker game, the revenue of an online casino can only be established in arrears, at the end of the period in question.

The traditional model of requiring the player to first register with an online casino or poker room to create a credit account on a gaming server, and to pre-fund the credit account by means of a payment instrument is unnecessarily restrictive, particularly in jurisdictions where usage of such payment instruments is not widespread.

There is thus a desire for an alternative on-line gaming model in which a player is able to commence online game play without first requiring the player to perform a registration step followed by pre-funding of a player credit account.

SUMMARY

Disclosed herein are embodiments of a method and system for managing tokens in an electronic gaming environment. The word "exemplary" is used herein to mean "serving as an example, instance, or illustration." Any embodiment described herein as "exemplary" is not necessarily to be construed as preferred or advantageous over other embodiments.

In an exemplary embodiment in the form of a method, the method includes issuing tokens usable to make wagers in electronic games, transferring the tokens from a token issuing device to recipients capable of making wagers in the electronic games, and cancelling any tokens that are lost to the "house" (e.g., an issuer of the tokens or an administrator that provides electronic gaming devices at which the electronic games are played) in any unsuccessful wagers in the electronic games.

In accordance with the exemplary embodiment, (i) the tokens may be issued by an issuing device that is operated by a token issuer, preferably a token issuer that offers electronic casino games, (ii) the recipients of the issued tokens may be players of the electronic casino games, and (iii) the issuer of the tokens is not responsible for settling the wagers in the electronic games. Alternatively, the issuer of the tokens may be responsible for settling the wagers.

In accordance with another exemplary embodiment, (i) the players are able to play the electronic casino games without having to establish accounts with the issuer of the tokens, (ii) the issued tokens are transferable between different levels of a multi-level distribution chain between the issuer of the tokens and the players, and (iii) the tokens are not transferable back to the issuer of the tokens.

In accordance with yet another exemplary embodiment, the recipients of the issued tokens are players in a multi-player game, the issuer of the tokens receives a commission when issuing the tokens, and the tokens are transferable to the accounts of players authorized to play the multi-player game. The accounts of the players may be maintained in data storage of electronic gaming devices used by the players at which the players play casino games.

These as well as other aspects and advantages will become apparent to those of ordinary skill in the art by reading the following detailed description, with reference where appropriate to the accompanying drawings. Further, it should be understood that the embodiments described in this summary and elsewhere are intended to be examples only and do not necessarily limit the scope of the invention.

BRIEF DESCRIPTION OF THE DRAWINGS

Exemplary embodiments of the invention are described herein with reference to the drawings, in which.

Figure 1:
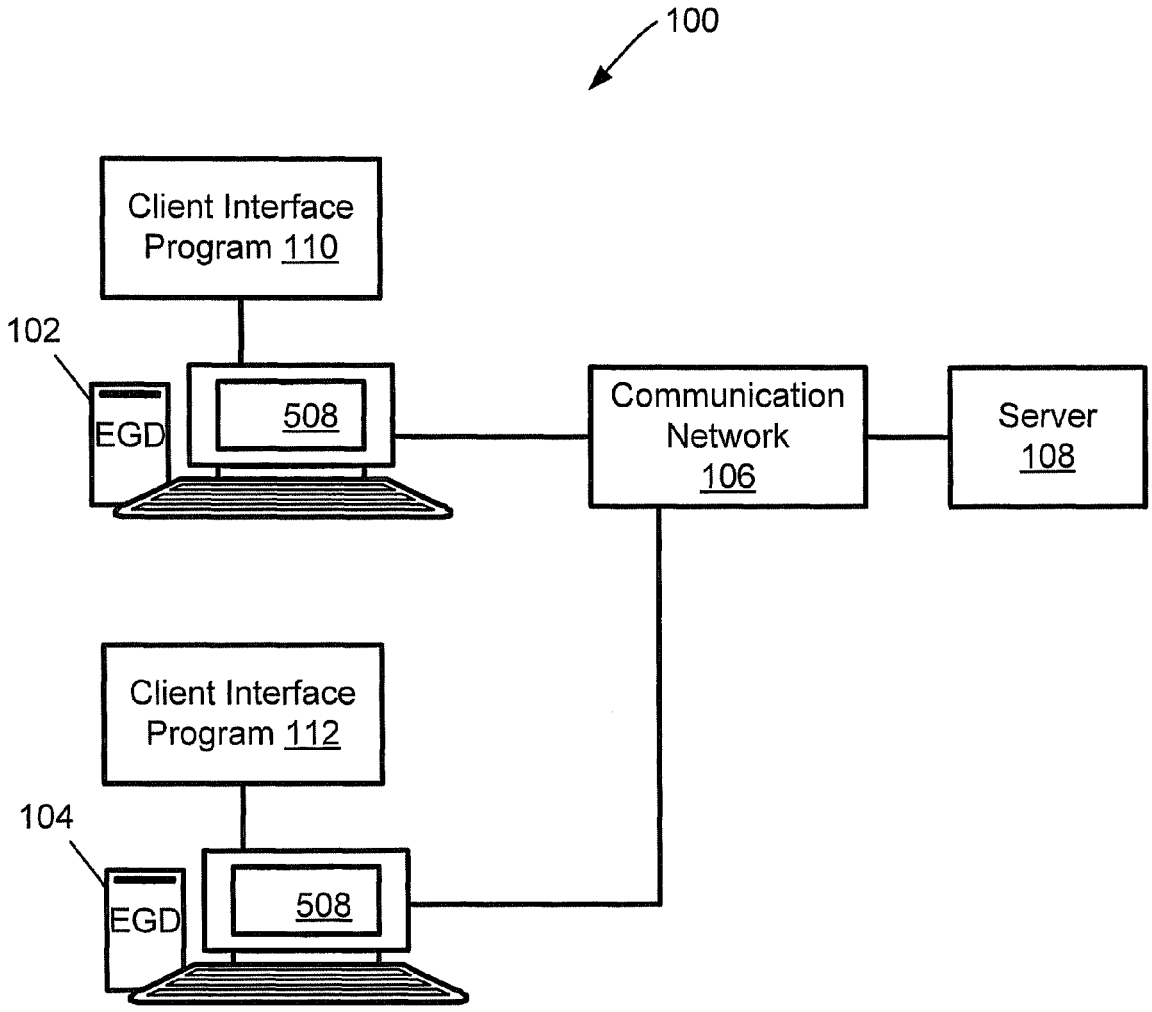
FIG. 1 is a block diagram of an exemplary token management system.

Reference numerals are shown in the drawings to identify various elements of the drawings.

DETAILED DESCRIPTION

1. Overview

The exemplary embodiments described herein include methods and systems for managing tokens of an electronic gaming environment. By way of example, the electronic gaming environment may include any element of a token management system and/or any location at which any portion of the token management system is located including any location at which electronic games may be played. The token management system may include a token management application (TMA) that is executable to carry out at least a portion of managing the tokens.

Unlike mechanical tokens that may be deposited into a token slot of a slot machine or another machine, the tokens used in the exemplary embodiments may include computer-readable tokens (e.g., data tokens). Computer-readable tokens may be stored in data storage electronically, magnetically, or in some other manner. Computer-readable tokens may be issued (e.g., sold and/or transferred) over a communication network. As an example, computer-readable tokens may be issued from an issuing device to a TMA server executing the TMA, and then from the TMA server to an electronic gaming device at which one or more of the tokens may be wagered. As another example, computer-readable tokens may be issued directly from the issuing device to an electronic gaming device at which one or more of the tokens may be wagered.

In accordance with the exemplary embodiments, the TMA server may be operated by an administrator. The administrator may run an Internet Café, betting parlor or some other enterprise at which electronic gaming devices are located. The issuing device may issue tokens directly or indirectly to a token account that is associated with the administrator and/or the TMA server operated by the administrator. Execution of the TMA at the administrator's TMA server may cause some or all of the tokens transferred to the administrator's token account to be transferred to a token account that is associated with a player that desires to play casino games and/or to an electronic gaming device at which the player intends to play the games.

Valid tokens are tokens that may be used by a player to play a casino game and/or to place a wager. Cancelled tokens, on the other hand, are tokens that may no longer be used by a player to play a casino game and/or to place a wager. Valid tokens may become cancelled tokens upon or after the player loses a game and/or loses a wager to the "house."

In an exemplary embodiment described herein, a token management system is provided in which players can participate in game play at a gaming server operated by a token issuer without requiring such players to (i) register with the issuer to create an account on the gaming server, and (ii) pre-fund such an account with a payment instrument prior to participating in game play. It is anticipated that this would increase the attractiveness of playing games offered by such an issuer to players who do not wish to make use of payment instruments to fund player accounts, and thus increase the quantity of players that participate in game play at the issuer's gaming server. It is further anticipated that this would enable issuers to derive revenue from game play in a manner that is not a function of gross win derived by the issuer over a particular period.

Players may participate in game play using distributed gaming workstations in which game play is managed by a central gaming server. U.S. patent application Ser. No. 10/513,140, which published as U.S. Patent Application Publication No. 20060063593, discloses an exemplary system whereby multiple distributed gaming workstations may engage in gaming play via a central gaming server over a computer network such as the Internet. The entire contents of U.S. patent application Ser. No. 10/513,140 are incorporated by reference herein, as if fully set forth in this description. In this regard, the exemplary methods of the present application may be implemented in a system of the type disclosed in U.S. patent application Ser. No. 10/513,140.

For purposes of this description, the symbol "$" is used in conjunction with a number to indicate a given number of United States dollars. A person of ordinary skill in the art will understand that the given number of United States dollars is merely exemplary and that using United States dollars to make cash payments could instead be made using the currency of a country or state other than the United States.

2. Exemplary Architecture

FIG. 1 illustrates an exemplary token management system 100 for providing casino game play to one or more players. It should be understood, however, that this and other arrangements described herein are for purposes of example only. As such, those skilled in the art will appreciate that other arrangements and other elements (e.g., machines, interfaces, functions, orders, and groupings of functions, etc.) can be used instead, and some elements may be omitted altogether. Further, many of the elements described herein are functional entities that may be implemented as discrete or distributed components or in conjunction with other components, in any suitable combination and location, and as any suitable combination of hardware, firmware, and/or software.

As illustrated in FIG. 1, token management system 100 includes electronic gaming devices (EGDs) 102, 104, a communication network 106, a server 108, and casino client interface programs 110, 112. Communication network 106 may include any number of communication links, which may include one or more wired communication links and/or one or more wireless communication links. As an example, communication network 106 may include the Internet or some portion of the Internet.

Electronic gaming devices 102, 104 are coupled through communication network 106 to server 108. Electronic gaming devices 102, 104 may allow players to play casino games, for example, by presenting the players with a display of game play. For purposes of this description, an electronic gaming device that will be, is being, and/or has been used by a player to play casino games may be referred to herein as the "designated gaming device." Additional electronic gaming devices may be coupled to gaming server 108 so as to allow more players, at any given time, to participate in casino gaming. Each of these additional gaming devices may execute another casino client interface program. These additional gaming devices and the other casino client interface programs are not shown for clarity of the figure.

Electronic gaming devices 102, 104 allow players to play any of a variety of casino games that may be served to the gaming devices by server 108. As an example, the casino games may include single-player games, multi-player games, and single-player/multi-player games. The single-player games may include, but are not limited to, slot machine games and a black jack card game. The multi-player games may include, but are not limited to, a multi-player card game such as any of a variety of poker card games. The single-player/multi-player games, which comprise games that may be played by a single player and/or by a plurality of players, may include, but are not limited to, a roulette wheel game. Other examples of single-player games, multi-player games, and single-player/multi-player games are also possible.

Electronic gaming devices 102, 104 may be arranged in any of a variety of configurations. For example, one or more of electronic gaming devices 102, 104 may be arranged as a client work station. Additionally or alternatively, one or more of electronic gaming devices 102, 104 may be arranged as (i) a slot machine at a live casino, a tavern, an Internet café, a betting shop, or at some other location, and/or (ii) a personal computer and/or a mobile telecommunication device that allows a player to participate in online gaming. A person skilled in the art of computer systems will understand that the exemplary embodiments are not limited to any particular class or model of computer employed for electronic gaming devices 102, 104 and the skilled person will be able to select an appropriate computer.

Figure 4:
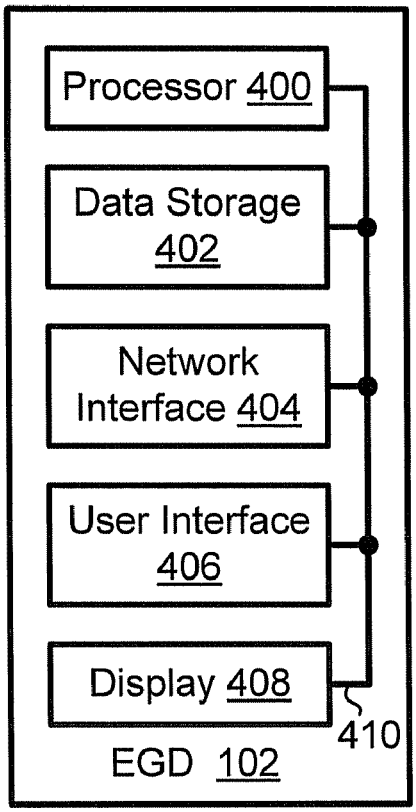
FIG. 4 is a block diagram depicting an exemplary electronic gaming device.

Next, FIG. 4 is a block diagram depicting exemplary details of electronic gaming device 102. Electronic gaming device 104, as well as one or more other electronic gaming devices, may be arranged as electronic gaming device 102. As illustrated in FIG. 4, electronic gaming device 102 includes (i) a processor 400, (ii) data storage 402, (iii) a network interface 404, (iv) a user interface 406, and (v) a display 408, all of which may be linked together via a system bus, network, or other connection mechanism 410.

For purposes of this description, a processor, such as processor 400, may comprise one or more general purpose processors (e.g., INTEL microprocessors) and/or one or more special purpose processors (e.g., digital signal processors). The processor may execute computer-readable program instructions that are stored in data storage.

For purposes of this description, data storage may comprise a computer-readable storage medium readable by a processor. The computer-readable storage medium may comprise volatile and/or non-volatile storage components, such as optical, magnetic, organic or other memory or disc storage, which can be integrated in whole or in part with a processor. The computer-readable medium may comprise a hard disc drive.

For purposes of this description, a network interface, such as network interface 404, may comprise a wireless network interface and/or a wired network interface for interfacing to communication network 106. The network interface is operable to transmit communications via network 106 to one or more other devices and to receive other communications that are transmitted via network 106 to the network interface. The network interface may be operable to interface to communication network 106 using any of a variety of communication protocols, such as General Packet Radio Service (GPRS), Universal Mobile Telecommunications Service (UMTS), High Speed Download Packet Access (HSDPA), Code Division Multiple Access (CDMA), Global System for Mobile Communications (GSM), Transmission Control Protocol/Internet Protocol (TCP/IP), or some other protocol.

For purposes of this description, a user interface, such as user interface 406, may be operable to receive user input and provide the received user input to a processor, data storage, a network interface, and/or a display linked to the user interface. As an example, user interface 406 may be operable to receive user input, such as a request for more tokens, a request to place a wager on a casino game, and/or a request to redeem tokens in a token account. Electronic gaming device 102 may receive the user input and, thereafter, responsively cause network interface 404 to transmit the user input, or a message based at least in part on the user input, via communication network 106 to server 108 and/or to another device connected to network 106.

Additionally, for purposes of this description, a display, such as display 408, may comprise a liquid crystal display (LCD) an Organic Light Emitting Diode (OLED) display, a cathode ray tube (CRT) display, or some other type of display.

Returning to FIG. 1, in accordance with an exemplary embodiment, electronic gaming devices 102, 104 are client workstations and server 108 is a gaming server that is remote from electronic gaming devices 102, 104, but linked thereto by communication network 106. One or more casino games are executable after a user of one of electronic gaming devices 102, 104 selects the one or more games. Each game offered by token management system 100 includes a server process, which is executable at gaming server 108, and a client process, which is executable at a designated gaming device, such as electronic gaming device 102.

The server process generates, upon request of the client process, one or more random events upon which an outcome of the casino game depends. Such random events can correspond, for example, to the roll of a die, the spin of a roulette wheel or the deal of a playing card, depending on which particular casino game is being played by the player.

The client process, on the other hand, presents to the user or player a simulation of the casino game being played. Presenting the game simulation may include displaying the game simulation on display 408. The client process also enables the player to place wagers on, and to control the progress of, the casino game, and displays to the player the outcome of the game as a function of the random events generated by the server process.

In order to communicate with gaming server 108, electronic gaming devices 102, 104 may operate under the control of casino client interface programs 110, 112, respectively. Casino client interface programs 110, 112 may be contained at data storage 402 and at data storage of gaming device 104, respectively. Execution of client interface programs 110, 112 may cause a menu system or menu selection system to display, via display 408, a menu of casino games that are offered by the particular online casino. Electronic gaming devices 102, 104 (in particular, user interface 406 and a user interface of gaming device 104) may present a graphical user interface ("GUI") including the menu selection system to the players. The players are able to select, via the menu subsystem, menu selection system, or the GUI, any game available for playing via gaming server 108.

In one respect, upon or after selecting a particular casino game for the first time, casino client interface program 110 may be executed so as to cause a software program corresponding to a client process for a particular casino game to be downloaded from gaming server 108 to electronic gaming device 102. After the software program has been downloaded, the program may be stored locally on data storage 402. Additionally, after the program has been downloaded, the player can then install the software program on electronic gaming device 102. Alternatively, after the program has been downloaded, electronic gaming device 102 may automatically install the program. Moreover, once the software program corresponding to the client process for the particular casino game has been downloaded and installed, the casino game can be played without having to download any other portion of the game.

In another respect, upon or after selecting the particular casino game for the first time, casino client interface program 110 may not require a download and installation of the software program as described above. Instead, the client process for the particular casino game may run from within an Internet browser application program such as INTERNET EXPLORER® by Microsoft Corporation, Redmond, Wash., United States, or FIREFOX® by Mozilla Corporation, Mountain View, Calif., United States. Such non-downloadable client interface programs can, for example, be written to operate in conjunction with an Internet browser plug-in application, such as the FLASH PLAYER application from Adobe Systems Incorporated, San Jose, Calif., United States. The Internet browser plug-in application may be arranged as program instructions contained in data storage 402 and executed by processor 400.

In accordance with an exemplary embodiment, a non-downloadable version of casino client interface program 110 may be written in a scripting language that can be interpreted by the FLASH PLAYER application. In this regard, a non-downloadable version of casino client interface program 110 is not a stand-alone executable file (e.g., an .exe file), but rather a script file that is loaded by an Internet browser application and interpreted (or "played") by a browser plug-in application. Both downloadable and non-downloadable versions may produce a substantially similar or identical GUI and game functionality. For example, a non-downloadable version of a casino client interface program may receive game results from gaming server 108 just as a downloaded and installed version of a casino client interface program does. A person having ordinary skill in the art will understand that casino client interface program 112, as well as one or more other casino client interface programs, may be arranged in a configuration similar to a configuration of casino client interface program 110.

Gaming server 108 may be arranged in any of a variety of configurations. For instance, gaming server 108 may include (i) a processor operable to execute computer-readable program instructions contained in data storage, (ii) the data storage containing the program instructions executable by the processor of gaming server 108, and (iii) a network interface. As an example, the program instructions contained within the data storage of gaming server 108 may include instructions that cause gaming server 108 to (i) serve a casino client process to electronic gaming devices 102, 104, and (ii) support a casino client process downloaded to electronic gaming devices 102, 104.

Figure 2:
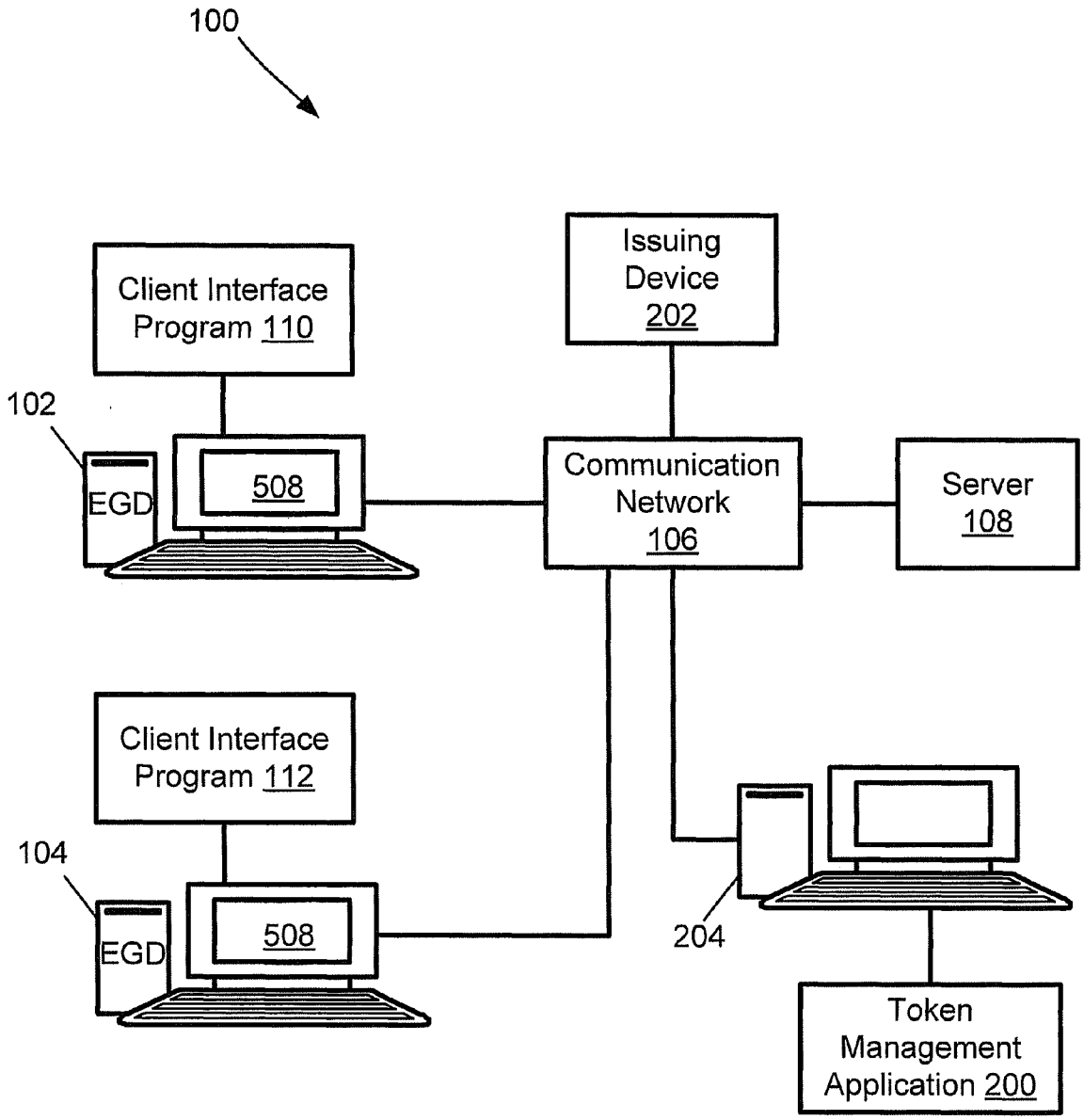
FIG. 2 is a block diagram of an exemplary token management system including a token management application.

Next, FIG. 2 illustrates additional details of token management system 100. As illustrated in FIG. 2, token management system 100 may include a token management application (TMA) 200, an issuing device 202, and a TMA server 204. Access to TMA 200 may be available only to TMA servers, such as TMA server 204, and to authorized users, such as electronic gaming devices 102, 104 functioning as client workstations. Although shown as separate entities, issuing device 202 and gaming server 108 may integrated into a single device having a processor that executes program instructions to carry out the functions described herein as being carried out by issuing device 202 and the functions described herein as being carried out by gaming server 108.

Figure 3:
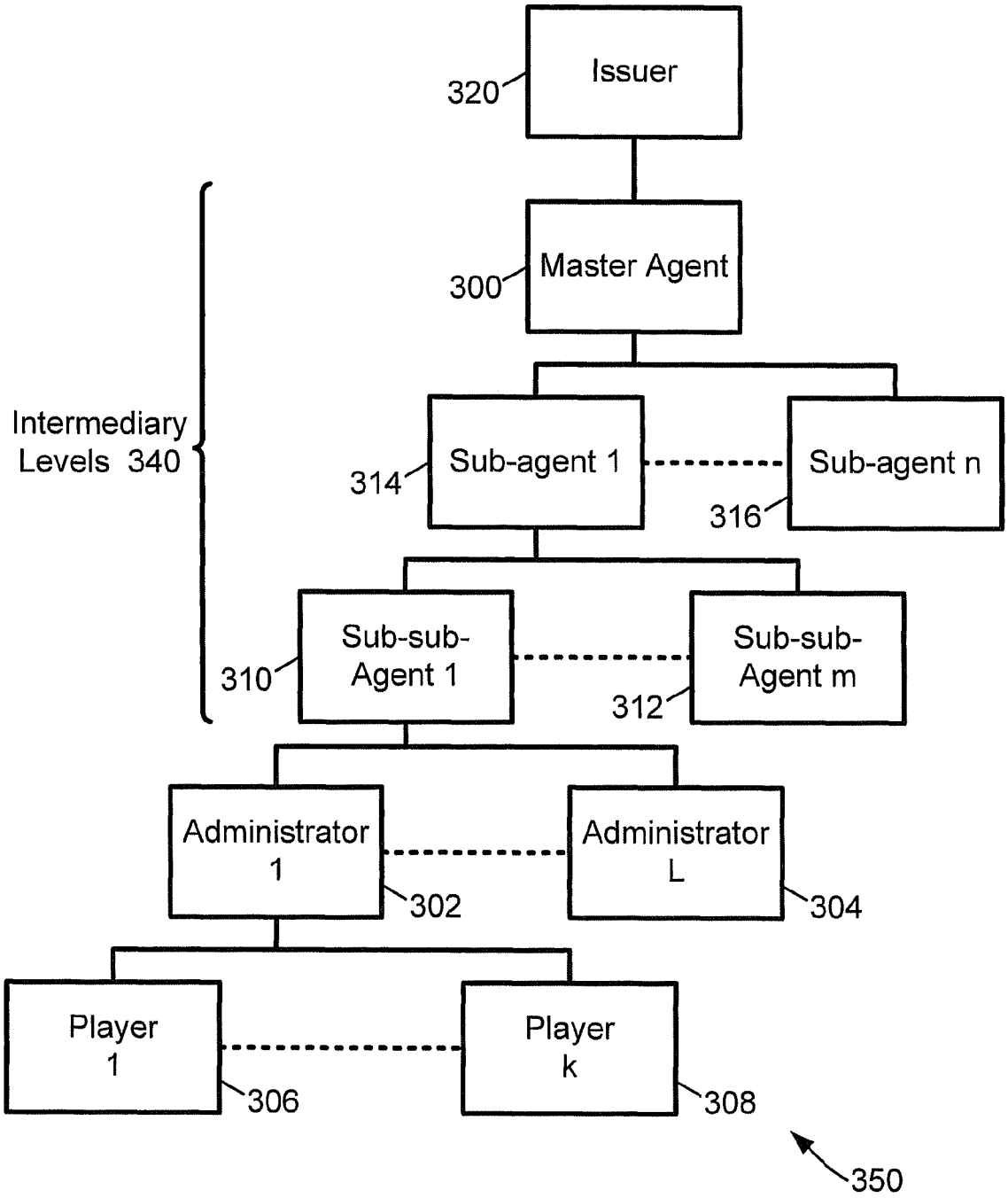
FIG. 3 is a block diagram depicting an exemplary hierarchy of devices having access to a token management application.

Next, FIG. 3 illustrates an exemplary hierarchy (or distribution chain) 350 for distribution of computer-readable tokens. Hierarchy 350 includes (i) an issuer level including issuer 320, (ii) a master agent level including a master agent 300, (iii) a sub-agent level including sub-agents 314, 316, (iv) a sub-sub agent level including sub-sub agents 310, 312, (v) an administrator level including administrators 302, 304, and (vi) a player level including players 306, 308. The dotted lines in FIG. 3 are intended to illustrate that at least one other player, administrator, sub-agent, and sub-sub-agents may be included within hierarchy 350. The master agent level may include one or more other master agents as well. The levels between the issuer level and the administrator level are intermediary levels 340. One or more levels of intermediary levels 340 may be omitted from hierarchy 350 or one or more additional intermediary levels may be added to intermediary levels 340.

Issuer 320 may operate issuing device 202. Issuing device 202 may include a processor and data storage containing computer-readable program instructions executable by the processor to cause issuance of tokens to another member of hierarchy 350. The program instructions of issuing device 202 may also include a TMA arranged to carry out at least one function of TMA 200.

Each agent and administrator in hierarchy 350 may operate a TMA server that executes a TMA. Each TMA server operated by a member of hierarchy 350 may be arranged as TMA server 204. Issuer 320 may produce and/or provide the TMA server and TMA to each member of intermediary levels 340.

The administrators of hierarchy 350 may operate electronic gaming devices that are playable by players 306, 308. For purposes of this description, administrator 302 operates TMA server 204 and electronic gaming devices 102, 104.

Figure 5:
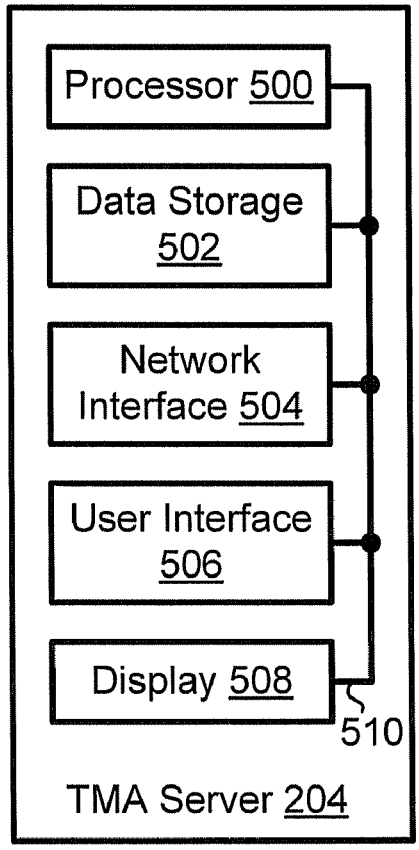
FIG. 5 is a block diagram depicting an exemplary token management application (TMA) server.

Next, FIG. 5 is a block diagram depicting details of TMA server 204. The TMA servers operated by members of hierarchy 350 other than administrator 302 may be arranged in a configuration similar to the configuration of TMA server 204. As shown in FIG. 5, TMA server 204 includes (i) a processor 500, (ii) data storage 502, (iii) a network interface 504, (iv) a user interface 506, and (v) a display 508, all of which may be linked together via a system bus, network, or other connection mechanism 510.

Processor 500 may execute computer-readable program instructions contained in data storage 502. Data storage 502 may contain computer-readable program instructions, such as (i) program instructions arranged as TMA 200, and/or (ii) program instructions that (a) cause tokens purchased by a player to be transferred to a token account associated with the player and/or to a designated gaming device at which the player is going to play casino games, (b) cause tokens to be accepted, from a player's token account and/or from a designated gaming device, for a player that has requested redemption of the tokens, and (c) cause tokens to be transferred to or from another TMA server. If issuer 320 is configured to redeem issued tokens, the program instructions contained in data storage 502 may include instructions that cause tokens to be transferred from the TMA server 204 to issuer 320.

User interface 506 may be operable to allow a user of TMA server 204 to send requests, such as request to purchase tokens from issuing device 202 and a request for issuing device 202 or another TMA server to redeem tokens. User interface 506 may also be operable to allow a user of TMA server 204 to request a balance of the token account associated with administrator 302 and/or a token account of an electronic gaming device operated by administrator 302. Display 508 may be operable to display a requested token account balance and/or a GUI that allows a user of TMA server 204 to log into gaming server 108.

Execution of TMA 200 may cause any of a variety of functions to be carried out. As an example, execution of TMA 200 may cause a token account to be established for a player and/or an electronic gaming device. As another example, execution of TMA 200 may cause a balance of an established token account to be adjusted. Adjustment of a token account balance may be carried out, for example, in response to purchase of one or more tokens, and/or redemption of one or more tokens. Gaming server 108 may adjust the token account balances as a result of a player winning or losing a wager placed on a casino game.

Issuer 320 may have a commercial relationship with master agent 300. As a result of this commercial relationship, issuer 320 may provide master agent 300 with elements shown in FIG. 2, such as electronic gaming devices 102, 104, TMA 200, and TMA server 204. In turn, master agent 300, may provide one or more of these elements to another member of intermediary level 340 for distribution, in turn, to yet another member of intermediary level 340, or to an administrator.

As a result of the commercial relationship between issuer 320 and master agent 300, master agent 300 may purchase tokens from issuer 320 so as to cause a TMA to adjust the balance of a master agent token account. According to an exemplary embodiment, master agent 300 may send to issuing device 202 a request to purchase a given number of tokens. In response to receiving the purchase request, issuing device 202 may transfer the given number of tokens to the master agent token account and/or to the TMA server operated by master agent 300.

3. Exemplary Operation

Administrator 302 may operate a physical Internet café or betting shop which has a number of electronic gaming devices (e.g., devices 102, 104) that can be used by casual players to play any casino game(s) that is/are available for play via gaming server 108. In this example, electronic gaming devices associated with administrator 302 may have casino client processes of the sub-class that do not require the player to (i) log in to gaming server 108 by means of a user name and password, and (ii) establish an account with gaming server 108.

In order to allow each electronic gaming device to be used by casual players, administrator 302 registers (e.g., establishes) on gaming server 108 a separate gaming device account corresponding to each of the electronic gaming devices. Registration of the electronic gaming devices may include gaming server 108 assigning each gaming device a corresponding username and password. Each such username and password pair may be stored at data storage 502 and used by administrator 302 to log the respective electronic gaming devices 102, 104 onto gaming server 108. Administrator 302 does not make these username and password pairs available to any players who wish to play casino games at electronic gaming devices 102, 104. It will be understood that each electronic gaming device 102, 104 appears to gaming server 108 as a conventional player that is continuously logged in to the gaming server.

Master agent 300 may purchase a predetermined number of tokens (e.g., 10,000 tokens) at an agreed price (e.g., $2,500) in accordance with the terms of the commercial relationship between master agent 300 and issuer 320. Alternatively, master agent 300 may purchase a number of tokens selected at the time of purchase. Issuer 320 may bear no further obligation to master agent 300 other than to ensure that gaming server 108 is accessible to the electronic gaming devices at which a player desires to play a game.

After master agent 300 purchases a given quantity of tokens (e.g., 10,000 tokens), a balance of a master agent token account may be increased by the quantity of purchased tokens. For example, if the master agent token account had a balance of 7,500 tokens prior to the purchase of the 10,000 tokens, upon updating master agent token account, the balance will be 17,500 tokens.

Administrator 302 may purchase from master agent 300 (and master agent 300 may sell to administrator 302) any of the tokens in the master agent token account. For example, administrator 302 may purchase 1,000 of the available tokens from master agent 300 at an agreed price of, say $500. If an administrator token account associated with administrator 302 had a balance of 0 tokens prior to the purchase of the tokens, then after the purchase, TMA 200 may adjust the administrator token account to have a balance of 1,000 tokens. In this way, administrator 302 now has a balance of 1,000 tokens to make available to any casual player who may wish to play casino games at any of electronic gaming devices 102, 104.

In some cases, the original seller (i.e., the issuer) of the tokens and each subsequent seller of tokens other than a player may charge a commission that may be used by the seller to earn a profit for its efforts and involvement in token management system 100. In this way, a given seller that sells issued tokens may sell the tokens at a price equal to the given seller's purchase price plus the given seller's commission. In other cases, such as when administrator 302 sells tokens to master agent 300 some time after administrator 302 purchased the tokens from master agent 300, administrator 302 may not charge master agent 300 a commission.

Additionally, in another case, such as when multiple players have played a multi-player card game, TMA 200 may transfer tokens from the token account associated with the electronic gaming device used by a losing player to the token account associated with the electronic gaming device used by the winning player. In this case, the losing player and the winning player may be playing the multi-player game via electronic gaming devices operated by administrator 302.

In yet another case, if the electronic gaming device used by the losing player of a multi-player card game is a gaming device operated by administrator 302 and if the electronic gaming device used by the winning player is a gaming device operated by administrator 304, the TMA 200 executed by the TMA server of administrator 302 may cause the losing player's wagered tokens to be transferred to the TMA server of administrator 304 for subsequent transfer of the wagered tokens to the electronic gaming device used by the winning player.

Alternatively, during the playing of a multi-player card game by players using gaming devices of different administrators, the wagered tokens may be transferred to an agent, such as sub-sub-agent 310. In accordance with this alternative, after gaming server 108 determines a winner of the multi-player game, gaming server 108 may notify sub-sub-agent 310 which player won the game, and sub-sub-agent 310 may responsively transfer all of the tokens wagered during the game to the to the TMA server of an administrator for subsequent transfer of the wagered tokens to the electronic gaming device used by the winning player.

A casual player who wishes to play casino games may purchase a quantity of tokens from administrator 302. The purchase of tokens by a casual player is typically via a cash payment, although the purchase could occur via another payment means such as a check or an electronic payment means (e.g., a credit card, a debit card). As an example, suppose the casual player purchases 100 tokens from administrator 302 at an agreed price of, say, $100. The balance of the token account associated with administrator 302 reduces by 100 tokens, to 900. Administrator 302 uses TMA 200 to allocate the player's 100 tokens to a designated gaming device that is available for use and/or to the player's token account. TMA 200 and/or administrator 302 generate a password that is given to the player, who can then use the password to commence play at the designated gaming device. At the start of play, the player will have 100 tokens that can be used to make wagers on the available casino games. The token balance of the designated gaming device that is in use by the player and/or the balance of the player's token account is decreased by any wagers made by the player and increased by any winnings arising out of the player's game play.

At any time, the player can request administrator 302 to redeem for monetary value (e.g., cash or a credit on a credit card account) the remaining tokens in the player's token account and/or on the designated gaming device. The request to redeem the tokens may be made via a message that gets transmitted from the designated gaming device to administrator 302.

In response to receiving the player's request (e.g., a message) to redeem the player's tokens, administrator 302 may use TMA 200 to acquire the remaining tokens from the player's token account and/or from the designated gaming device. For example, suppose the player's token account and/or the designated gaming device has a balance of 50 tokens at the time the player desires to cease playing (e.g., at the time the player requests redemption of the tokens). Administrator 302 may use TMA 200 to flush the player's token account and/or a token account associated with the designated gaming device. The flushed tokens are transferred to the token account associated with administrator 302, such that the balance of the administrator's token account increases by 50 tokens (e.g., from 900 tokens to 950 tokens). Flushing the player's token account may include settling the balance of the player's token account and/or the token account associated with the designated gaming device to zero.

Additionally, in response to the player's request to redeem the player's tokens and/or in response to flushing the player's tokens, administrator 302 may redeem the tokens by making a monetary payment to the player. The monetary payment may be made via the same payment means used by the player to purchase the tokens (e.g., cash, check, or electronic payment) or via a payment means other than the payment means used to purchase the tokens. Administrator 302 may redeem each token at the same unit price at which the tokens were sold to the player. In the case in which the player requests redemption of 50 tokens, administrator 302 may, for example, pay the player $50 cash.

In addition to the tokens that are created when issuer 320 issues tokens to a purchaser, other tokens may be created in response to a successful wager on a casino game. For example, if administrator 302 has 1,000 tokens in its token account and then sells 100 tokens to a given player, and if the given player plays one or more casinos games and wins a net increase of 50 tokens such that the balance of the given player's token account is 150 tokens, the net increase of 50 tokens are created in response to successful wagers on the casino game(s). If the given player has administrator 302 redeem the 150 tokens, the token account of administrator 302 then has a balance of 1,050 tokens. Administrator 302 should have sufficient cash or other payment means to pay any player redeeming their tokens. Upon redeeming the 150 tokens, administrator 302 has suffered a loss of $50. However, administrator 302 may recover a portion of this loss by selling the additional 50 tokens to another player. The recovered loss would equal the additional 50 tokens times the seller's commission charged by administrator 302.

Additionally, instead of redeeming tokens, at a given time, the player could exit the game playing mode at an electronic gaming device, and at another time occurring after the given time, the player could re-enter the player's password at the electronic gaming device (or another gaming device operated by and/or linked to administrator 302) so as to allow the player to resume playing casino games with the player's remaining tokens.

Administrator 302 may also sell all or part of the tokens in the administrator's token account balance back to master agent 300 at an agreed unit price, which may be the same price at which they were acquired, or at a discounted price. In one exemplary embodiment, TMA 200 does not permit issuer 320 to redeem any tokens from master agent 300. In accordance with this exemplary embodiment, it will be understood by those having ordinary skill in the art that any token that is issued by issuer 320, arising out of a purchase by master agent 300, will remain in circulation until it is consumed in response to a player losing a wager on a casino game. Until this occurs, the token may be transferred between administrator 302, players, and master agent 300 by means of TMA 200.

In another exemplary embodiment, TMA 200 permits issuer 320 to redeem tokens, such as tokens in a token account of master agent 300 or administrator 302, at an agreed upon price. In accordance with this embodiment, any tokens that are redeemed by issuer 320 may be retired (e.g., cancelled) from circulation in token management system 100.

The examples above are described with reference to a single master agent and a single administrator. As shown in FIG. 3, it is, of course, possible for master agent 300 to be linked to a plurality of different administrators (e.g., administrators 302, 304), each of which operates a separate physical establishment with its own electronic gaming device(s). There is no limit to the number of electronic gaming devices that can be operated by each of the administrators.

As illustrated in FIG. 3, hierarchy 350 may include intermediary levels 340 interposed between master agent 300 and an administrator level including administrators 302, 304. Each administrator of the administrator level may be an agent between the issuer 320 and one or more players. As an example, in hierarchy 350, each administrator may be arranged as a sub-sub-sub agent. Intermediaries 340 may include (i) a sub-agent level including sub-agents 314, 316, and (ii) a sub-sub-agent level including sub-sub-agents 310, 312. The dotted line between sub-agents 314, 316 represents that intermediaries 340 may include one or more additional sub-agents, and the dotted line between sub-sub-agents 310, 312 represents that intermediaries 340 may include one or more additional sub-sub-agents. Thus, as illustrated in FIG. 3, a multi-level hierarchy of interested parties can exist, each of which is provided with access to issuer 320.

In one respect, TMA 200 may not permit master agent 300 to transact (e.g., transfer tokens) directly with administrators 302, 304. Instead, TMA 200 may only allow a device at a given level of hierarchy 350 to transact with a device at the next lower level and the next higher level of hierarchy 350. By way of example, if users of TMA 200 are arranged according to hierarchy 350, (i) master agent 300 will only be able to transact with sub-agents 314, 316 and issuer 320, (ii) sub-agent 314 will only be able to transact with master agent 300 and sub-sub-agents 310, 312, (iii) sub-sub-agent 310 will only be able to transact with sub-agent 314 and administrators 302, 304, (iv) administrator 302 may only transact with sub-sub-agent 310 and players 306, 308, and (v) player 306 may only transact with administrator 302.

In another respect, TMA 200 may allow a device on a given level of hierarchy 350 to transact with other devices on that given level. For example, TMA 200 may allow administrator 302 to transact with administrator 304. In this way, tokens from one administrator may be transferred to another administrator, where the other administrator is linked to a designated gaming device being used by a player that won a multi-card poker game.

In yet another respect, TMA 200 may allow a device on a given level of hierarchy 350 to transact with a device on any level of hierarchy 350. For example, master agent 300 may transact with sub-agent 314, sub-sub-agent 310, and/or administrator 302. Likewise, administrator 302 may interact with sub-sub-agent 310, sub-agent 314, and master agent 300. Other examples of devices transacting with other devices within hierarchy 350 are also possible.

Master agent 300 is responsible for ensuring that there is sufficient liquidity of tokens available to the various members in hierarchy 350 so as to enable players to play the casino games. When the number of issued tokens has reduced sufficiently, master agent 300 may purchase an additional quantity of tokens from issuer 320 so as to inject additional token liquidity into token management system 100. Similarly, sub-agent 314 may acquire more tokens from the master agent 300 when the token account balance of sub-agent 314 is deemed to require additional tokens. For this reason, TMA 200 may allow each member in hierarchy 350 to observe the token balances of other members directly beneath it at all lower levels in hierarchy 350 or, as an alternative, directly beneath it at the next lower level in hierarchy 350.

When a player plays a casino game on a designated gaming device, any token lost to the gaming server in an unsuccessful wager is cancelled, thereby diminishing the player's token account and the pool of tokens in circulation by the number of lost tokens. However, a different paradigm may be used in the case in which players participate in a multi-player game (e.g., a multi-player card game such as poker). In this latter case, issuer 320 may issue (e.g., sell) tokens to master agent 300 at a market-related price that is sufficient to provide issuer 320 with a profit after meeting its obligations (e.g., ensuring that gaming server 108 provides the electronic gaming devices of each administrator and/or electronic gaming devices of registered players with access to casino games).

An administrator (e.g., administrator 302) may sell tokens at a price relative to the price paid when purchasing those tokens from master agent 300, a sub-agent, sub-sub-agent, or issuer 320 (if there is no intermediary between the administrator and the online casino) and may not levy a commission (or "rake") on a cumulative amount of all player wagers in a multi-card game. In this way, the multi-player card game becomes a true zero-sum game in which the winner or winners receive the cumulative amount of wagers placed by the losing players.

In the case in which a player is participating in multi-player card game, it is envisaged that different administrators will pool their players in a network topology in order to increase liquidity in the multi-player game. In such a network topology, tokens may be transferred and/or "flushed" from the token account(s) of the losing player(s) to a token account of a winning player or alternatively from the token account of an administrator of the losing player(s) to the token account of the administrator of the winning player. Using the network topology, the losing player(s) and the winning player may access gaming server 108 via different administrators. It will be appreciated by a person having ordinary skill in the art that, in such a network topology, each administrator may want to sell tokens to their players at the same price so as to avoid any economic distortion, as a player may redeem tokens via an administrator that did not sell the tokens to that player.

An administrator (e.g., administrator 302) may seek to convert casual players who frequent the establishment where administrator 302 is located into more traditional online casino players who are able to play casino games at other locations away from the establishment such, for example, on a mobile phone or at a computer workstation at the player's residence or place of employment.

If a player wishes to access gaming server 108 and play casino games away from the establishment where administrator 302 is located, administrator 302 may use token management system 100 to register the player on gaming server 108. Registering the player may result in establishing a player account with gaming server 108 so as to make the player an authorized user of gaming server 108. Registering the player may include administrator 302 executing program instructions that cause a designated gaming device to display a prompt (e.g., a textual message, a still image, an audio message, a video image, and/or a GUI) that provides a casual player with the ability to enter registration data that can be used to establish the player as an authorized user of gaming server 108. After entry of the registration data at the designated gaming device, the registration data may be sent directly (or indirectly, by way of administrator 302) to gaming server 108. As an example, the registration data may include, but is not limited to, (a) the player's, first and last name, (b) the player's e-mail address, (c) the player's date of birth, enabling TMA 200 to verify that the player is of legal age, (d) the player's mobile telephone number, and (e) a currency in which the player purchases or redeems tokens. The registration data provided to gaming server 108 may be subsequently stored in data storage of gaming server 108.

If the player wishes to also play the casino games from a mobile telecommunication device, registering the player may include administrator 302 providing to gaming server 108 any of the following additional information relating to the player: (f) an indication whether the player wishes to receive GPRS settings to the player's mobile telecommunication device, and (g) wherein when the indication of (f) is affirmative, an indication of the player's mobile network operator and an indication of the player's mobile telecommunication device, such as a make and model of the player's mobile telecommunication device.

During registration or once registration has been completed, gaming server 108 may generate account details consisting of, for example, a username and password to enable the player to access gaming server 108 from a computer workstation, and a PIN code for accessing gaming server 108 from a mobile telecommunication device. The account details may be e-mailed to the player and sent by short messaging service (SMS) text message to the player's mobile telecommunication device. Gaming server 108 may generate a player token account to track a balance of tokens associated with the player accessing gaming server 108 from a mobile telecommunication device.

If the player has been registered for mobile play, token management system 100 may transmit to the player's mobile telecommunication device an SMS text message, or another type of message, containing a hyperlink. The player may activate the hyperlink via the mobile device so as to cause gaming server 108 to download a casino client interface program to the player's mobile device. The interface program may be manually or automatically installed on the player's mobile device. The player is then able to log in to issuer 320 and/or gaming server 108 from the mobile telecommunication device using the previously-received PIN code. After logging in to gaming server 108, the player may play a casino game installed on the mobile device and/or running on the mobile device, download a new casino game, install a downloaded game, purchase tokens, redeem tokens, or perform any of a variety of other functions. By way of example, downloading the casino client interface program may occur via a wireless data transmission according to a network protocol such as GPRS, UMTS, HSDPA, CDMA, GSM, or some other protocol.

The player using the player's mobile telecommunication device may purchase tokens from administrator 302 in the same manner as described above and administrator 302 may use TMA 200 to transfer the purchased tokens to the player's token account and to reduce the player's token account by an equivalent amount. The player can, at any time, request administrator 302 to redeem for monetary value the player's remaining token balance, in which case administrator 302 acquires the remaining tokens from the player at the same unit price at which they were sold to the player or at another unit price, and uses TMA 200 to flush the token balance of the player's token account and to increase the token account associated with administrator 302 by the amount of tokens flushed from the player's token account.

Administrator 302 or another agent may execute program instructions to reward players with free tokens. In this regard, for example, administrator 302 may execute program instructions to detect an event for which administrator 302 rewards free tokens. Such events may include, but are not limited to, a player playing a given number of casino games via a designated gaming device that is linked to administrator 302, a player purchasing a given number of tokens from administrator 302, and a player establishing a token account with gaming server 108 and/or TMA 200 so that the player can play casino games via the gaming server 108 via the player's mobile communication device or a computer workstation at the player's residence or place of employment. In response to the player establishing the account, issuer 320 may execute program logic that causes the token account associated with administrator 302 to be increased by a number of tokens that is greater than the amount of free tokens provided to the player. TMA 200 may include the program instructions for rewarding players with free tokens.

4. Conclusion

Exemplary embodiments of the present invention have been described above. Since many modifications, variations and changes in detail can be made to the described embodiments, it is intended that all matters in the preceding description and shown in the accompanying drawings be interpreted as illustrative and not in a limiting sense.

We claim:

1. A method for managing computer-readable data tokens in an electronic gaming environment, the method comprising:

transmitting, using a user interface of an agent device, a request to purchase a plurality of computer-readable data tokens created by an issuing device, wherein the agent device comprises a network interface that interfaces to a communication network;

receiving, at the agent device, the plurality of computer-readable data tokens, wherein the plurality of computer-readable data token is transferred to the agent device from the issuing device via the communication network, and wherein each computer-readable data token of the plurality of computer-readable data tokens is usable to make a wager in an electronic game;

storing, using the agent device, the plurality of computer-readable data tokens into a token account associated with the agent device;

transferring, using the agent device, at least one computer-readable data token from the token account associated with the agent device to a token account associated with a player that risks cancelation of the at least one computer-readable data token by wagering the at least one computer-readable data token in the electronic game; and cancelling the at least one computer-readable data token if the wager in the electronic game is unsuccessful, wherein cancelling the at least one computer-readable data token changes the at least one computer-readable data token from a valid token to a canceled token that is prevented from being used to place another wager.

2. The method of claim 1, further comprising:

transferring at least one other computer-readable data token, issued by the issuing device, to the token account of the player; and redeeming, at the agent device, the at least one other computer-readable data token for a monetary value, wherein the issuing device is arranged to not redeem tokens including the plurality of computer-readable data tokens and the at least one other computer-readable data token.

3. The method of claim 1, wherein the at least one computer-readable data token is redeemable via an intermediary device operating between the issuing device and an electronic gaming device at which the electronic game is played.

4. The method of claim 1, wherein the at least one computer-readable data token is non-redeemable, wherein the electronic game comprises an electronic casino game served by a gaming server, and wherein the player is able to play the electronic casino game without registering to have an account with the gaming server.

5. The method of claim 1, wherein the electronic game comprises an electronic casino game, and wherein the player is able to play the electronic casino game without establishing an account with a gaming server that serves the electronic casino game to an electronic gaming device.

6. The method of claim 1, wherein the at least one computer-readable data token is transferable between different levels of a multi-level distribution chain between the issuing device and the agent device.

7. The method of claim 1, wherein the at least one computer-readable data token is non-redeemable by the issuing device.

8. The method of claim 7, wherein the at least one computer-readable data token is redeemable for monetary value by an agent device but not the issuing device.

9. The method of claim 1, wherein, if the wager in the electronic game is successful, a quantity of computer-readable data tokens within the token account associated with a player is increased, and wherein the at least one issued computer-readable data token remains in circulation within the electronic gaming environment until the at least one issued computer-readable token is canceled as a result of placing a losing wager on a casino game.

10. The method of claim 1, tracking a balance of computer-readable data tokens within the token account associated with the player, wherein the balance of computer-readable data tokens indicates a quantity of computer-readable data tokens, and displaying, at a display device, the balance of computer-readable data tokens within the token account associated with the player.

11. The method of claim 1, further comprising:

creating, at the agent device, a plurality of computer-readable data tokens for paying off successful wagers placed by the player; and redeeming, at the agent device, the plurality of computer-readable data tokens created at the agent device.

12. The method of claim 11, wherein, upon redeeming the plurality of computer-readable data tokens created at the agent device, the quantity of computer-readable data tokens in the token account associated with the agent is greater than a quantity of the plurality of computer-readable data tokens issued by the issuing device and transferred to the agent device.

13. The method of claim 1, wherein a selling price of each token of the plurality of computer-readable data tokens transferred into the token account associated with the agent device is less than a selling price of each token of the at least one issued computer-readable data token transferred into the token account associated with the player.

14. The method of claim 1, further comprising:

circulating each token of the plurality of computer-readable data tokens between the agent and multiple player accounts until that token is cancelled.

15. A system for managing computer-readable data tokens in an electronic gaming environment, the system comprising:

one or more electronic gaming devices, each electronic gaming device configured to display game-play of an electronic game being played at the electronic gaming device;

a server coupled to the one or more electronic gaming devices via a communication network, wherein the server generates an outcome for each electronic game being played at one of the electronic gaming devices; and an agent device comprising a processor, a user interface, a token management application executable by the processor, and a network interface to the communication network, wherein the user interface transmits a request to purchase a plurality of computer-readable data tokens, each computer-readable data token is useable to place at least one wager on an electronic game to be played at one of the electronic gaming devices, wherein the network interface receives the plurality of computer-readable data tokens via the communication network from an issuing device that creates each of the computer-readable data tokens, wherein execution of the token management application causes (i) at least one of the computer-readable data tokens to be transferred from a token account of the agent device to a token account of a player that risks cancelation of the at least one of the computer-readable data tokens by placing a wager in an electronic game at one of the electronic gaming devices, and (ii) cancelation of the at least one of the computer-readable data tokens if the wager in the electronic game at one of the electronic gaming devices is unsuccessful, and wherein cancelation of the at least one of the computer-readable data tokens changes the at least one of the computer-readable data tokens from a valid token to a canceled token that is prevented from being used to place another wager.

16. The system of claim 15, further comprising:

an intermediary device operating within the electronic gaming environment between the issuing device and the electronic gaming device, wherein the at least one of the computer-readable data tokens is redeemable via the intermediary device.

17. The system of claim 15, wherein the issuing device is not responsible for settlement of the wager in the electronic game.

18. The system of claim 15, further comprising:

an intermediary device between the issuing device and the electronic gaming device, wherein the intermediary device is responsible for settling the wager in the electronic game.

19. The system of claim 18, wherein the at least one of the computer-readable data tokens is redeemable for monetary value.

20. The system of claim 15, further comprising:

a multi-level distribution chain between the issuing device and the agent device, wherein the at least one of the computer-readable data tokens is transferrable between different levels of the multi-level distribution chain.

21. The system of claim 15, wherein the agent device further comprises a data storage device containing the token account of the agent device and the token account of the player.

22. The system of claim 15, wherein, if the wager in the electronic game is successful, a quantity of computer-readable data tokens within the token account of the player is increased, and wherein the at least one of the computer-readable data tokens remains in circulation within the electronic gaming environment until the at least one of the computer-readable tokens is canceled as a result of placing a losing wager on a casino game.

23. The system of claim 15, further comprising:

a display device of the electronic gaming device, wherein a balance of computer-readable data tokens within the token account associated with the player is tracked, wherein the balance of computer-readable data tokens indicates a quantity of computer-readable data tokens, and wherein the display device is arranged to display the balance of computer-readable data tokens within the token account associated with the player.

24. The system of claim 15, wherein the electronic game at one of the electronic gaming devices is a slot machine game.

25. The system of claim 15, wherein the electronic game at one of the electronic gaming devices is a black jack card game.

26. The system of claim 15, wherein the electronic game at one of the electronic gaming devices is a single-player game.

27. The system of claim 15, wherein the electronic game at one of the electronic gaming devices is a multi-player game.

28. The system of claim 27, wherein the multi-player game is a poker card game.

29. The system of claim 15, wherein the electronic game at one of the electronic gaming devices is a roulette wheel game.

* * * * *